US009189982B1

(12) United States Patent
Stone et al.

(10) Patent No.: US 9,189,982 B1
(45) Date of Patent: Nov. 17, 2015

(54) SYSTEM FOR INSTALLING FILM CONTAINING A MESSAGE ON A VEHICLE

(71) Applicants: Gregory Michael Stone, Tomball, TX (US); Donna Marian Stone, Tomball, TX (US)

(72) Inventors: Gregory Michael Stone, Tomball, TX (US); Donna Marian Stone, Tomball, TX (US)

( * ) Notice: Subject to any disclaimer, the term of this patent is extended or adjusted under 35 U.S.C. 154(b) by 399 days.

(21) Appl. No.: 13/646,408

(22) Filed: Oct. 5, 2012

Related U.S. Application Data

(60) Provisional application No. 61/551,172, filed on Oct. 25, 2011.

(51) Int. Cl.
*G09F 21/04* (2006.01)

(52) U.S. Cl.
CPC ..... *G09F 21/04* (2013.01)

(58) Field of Classification Search
CPC ..... B60J 11/00
USPC ..... 280/770; 40/584, 588, 590, 594, 600, 40/601, 604, 605
See application file for complete search history.

(56) References Cited

U.S. PATENT DOCUMENTS 5,312,145 A * 5/1994 McNeil ..... 293/128
2007/0000606 A1 1/2007 Steelman et al.

* cited by examiner

*Primary Examiner* — Lynda Salvatore
(74) *Attorney, Agent, or Firm* — Buskop Law Group, PC; Wendy Buskop

(57) ABSTRACT

A system for applying a film having a smooth message over an irregular area of a vehicle in an accelerated manner, without heat, unnecessary tools, or extra training. This system can provide improved static resistance for the vehicle and cathodic protection while creating a surface of the smooth message to adhere.

19 Claims, 2 Drawing Sheets

SYSTEM FOR INSTALLING FILM CONTAINING A MESSAGE ON A VEHICLE

CROSS REFERENCE TO RELATED APPLICATIONS

The present application claims the priority to and the benefit of U.S. Provisional Patent Application Ser. No. 61/551,172 filed on Oct. 25, 2011, entitled "ACCELERATED SYSTEM FOR INSTALLING FILM CONTAINING A MESSAGE ON A TRANSPORT VEHICLE." This Reference is hereby incorporated in its entirety.

FIELD

The present embodiments generally relate to a system for installing a film forming a smooth message over an irregular area for a vehicle.

BACKGROUND

A need exists for a system for applying a film as a smooth message on an irregular area for a vehicle that is fast, easy, heatless, tool-less and environmentally friendly.

A further need exists for an application system that is easy for unskilled laborers to use.

The present embodiments meet these needs.

BRIEF DESCRIPTION OF THE DRAWINGS

The detailed description will be better understood in conjunction with the accompanying drawings as follows.

Figure 1A:
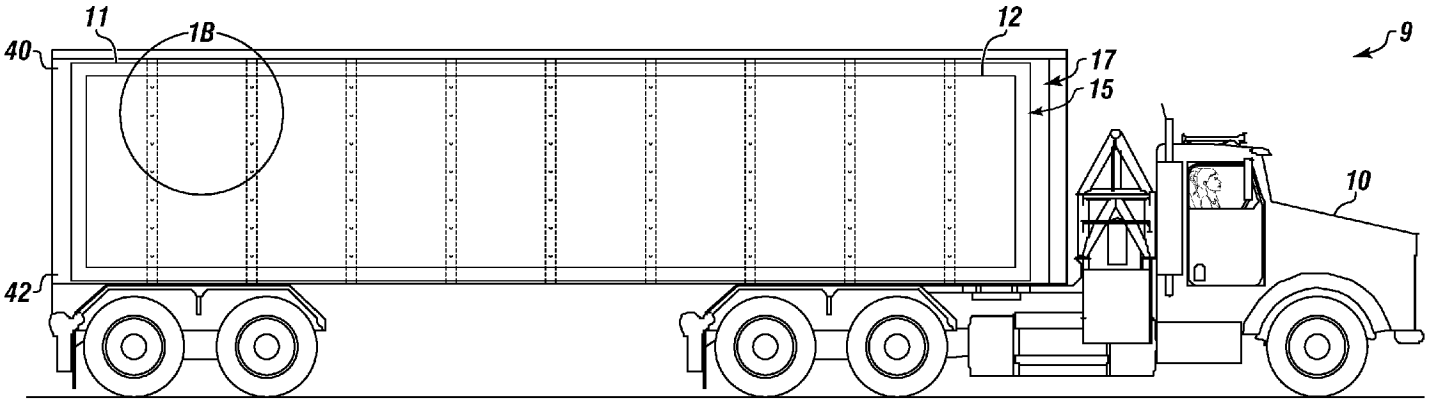
FIG. 1A is a side view of a vehicle with the installed smooth message according to one or more embodiments.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

The present embodiments generally relate to a system for installing a film smoothly to present a smooth message over an irregular area for accelerated attachment of the message to a vehicle, such as a truck, a monorail, a train side, a bus, a school bus, an enclosed trailer, a cruise ship, a barge, or a container used with container ships.

The system can use a heatless apparatus that requires no electricity and improves automation of the installation procedure, allowing individuals to use the system without significant training. Other tools that are not needed with embodiments of the system can include hammers, brushes, rollers, EXACTO™ blades or pinwheels.

The system can be implemented quickly and easily, without requiring holes to be formed in the film to allow air bubbles to collapse. One or more embodiments of the system can have significant advantages over currently available systems, such as not requiring air pockets to be made, not requiring rivets on a truck to be heated, and not requiring holes to be formed in the film.

The system can prevent damage to film with the message, thereby significantly reducing waste associated with damaged films.

The system can allow more vehicles to have graphics films installed faster, error free and more efficiently, which can generate more marketing, thus generating more sales for a company that is marketing on the vehicle.

The system can allow the film to be installed with less training and experience. The ease of application of the film can allow a greater number of less skilled shops to handle projects they would normally be forced to turn away, which can generate more sales.

The system can reduce the time spent on installation, which can lead to more profits as well as more time spent on other projects. A more prolific graphics shop will need more supplies thus adding to economic growth.

The system can also have a lower environmental impact as it does not require heat to apply the film, which is generally derived from butane, propane or electric sources.

In one or more embodiments, the film can be a vinyl film. The messages can include words, graphics, fluorescent paint, sparkles, or other features. The system can enable the message to be bubble free, thereby removing the need for workers to create holes in the film due to the bubbles and preventing failure of adhesion of the film on the rigid surface of the vehicle.

As an example, the smooth message can be made of a film, which can be sized to fit any vehicle, such as a delivery truck, which can range from about 7 feet to about 12 feet high, about 8 feet to about 40 feet long, and can have a film thickness of about $1/64^{th}$ of an inch.

The system can include a vehicle, which can have at least one rigid surface with an irregular area, such as a bus or a car with rivets on the rigid surface. The vehicle can have two or more rigid surfaces, such as a rigid back and two sides. For example, a light rail transport vehicle can have a front, a back, and two sides.

Unexpectedly, one or more embodiments can also provide a form of cathodic protection to the sides of the vehicle, when the rigid surface of the vehicle can be metal.

The system can include a plurality of compressible flexible strips, such as two compressible flexible strips, which can be used for attaching the smooth message over the irregular area. The compressible flexible strips can be connected in series over an irregular area, in parallel over the irregular area, or both.

The compressible flexible strips can provide an interruption in ionic charge build up, providing improved resistance to static charge buildup for the vehicle. This unexpected benefit reduces rusting on components of the vehicle and reduces charge discharge at gas pumps, particularly in areas, such as Arizona, where gas pump fires often occur due to static charge buildup in vehicles.

The flexible strips can resist breaking and shattering and can maintain an original shape in various temperatures. For example, the flexible strips can be made of a material that is resistant to breakage, shattering and deformation at temperatures ranging from about −30 degrees Fahrenheit to about 140 degrees Fahrenheit.

One or more embodiments of the compressible flexible strips can cover the irregular area, reducing deterioration of the components due to charge build up other than static charge buildup.

The flexible strips can be made of polyolefin polymer, a high impact polystyrene (HIPS), a lightweight metal, an aluminum composite, such as those made by Nudo Products Inc. of Springfield, Ill. or combinations thereof.

The compressible flexible strips can have a compressible first side, such as a first side made from high impact polystyrene or flexible polyvinyl chloride, which can be connected longitudinally with the covering section. In one or more embodiments the compressible flexible strips can be non-porous and/or non-perforated.

The compressible first side can attach flush with the rigid surface of the vehicle upon application of a compression pressure, such as a compression pressure ranging from about 10 psi to about 25 psi.

The compressible flexible strips can have a compressible second side, such as a second side made of the same material as the first side.

The compressible first and second sides can be adhered to the rigid surface of the vehicle, such as with a static charge resistant adhesive or a reinforced double sided adhesive tape, such as one made by 3M, Inc. of St. Paul, Minn.

The compressible first and second sides can each taper to a thickness that is different from the original compressible first and second side thickness.

The compressible first side and compressible second side can taper to a thickness which is less than 10 percent of the original compressible first and second side thickness. The taper can range from about 2 percent to about 9.5 percent of the original thickness. The taper can create a smooth seamless edge.

The taper can prevent the compressible first side and compressible second side from making a groove or from distorting the image of the film.

The compressible first side and compressible second side can each have top edges and bottom edges.

The top and bottom edges of the compressible first side and compressible second side can have top edge beveled portions and bottom edge beveled portions. The term "beveled" as used herein can refer to a shape that is rounded or non-angular, such as arched.

The system can have an adhesive that is completely removable, which can leave the rigid surface clean when the smooth message is removed.

The covering section can be disposed between the compressible first and second sides.

A covering section can extend from about $1/8^{th}$ of an inch to about $1/4^{th}$ of an inch from the vehicle.

The covering section of the compressible flexible strips can have a smooth outer surface and an inner surface, such as a smooth and non-porous metal surface or a high impact strength polystyrene surface with a thickness ranging from about $1/64^{th}$ of an inch to about $1/4^{th}$ of an inch. The covering section can be used for enclosing the irregular area.

The covering section can be a laminate composed of one or more materials.

The covering section can be made from HIPS available from Laird Plastics of Houston Tex., or a sheet of lightweight aluminum available from Wrisco Industries of Dallas, Tex.

The term high impact polystyrene "HIPS" as used herein can refer to a low cost plastic material that is easy to machine and fabricate. HIPS is often specified for low strength structural applications when impact resistance, machinability, and low cost are required. HIPS has excellent dimensional stability and is easy to fabricate, paint and glue. HIPS has the advantage of occurring in a natural color and can be translucent white in embodiments.

The following physical property information is based on typical values of the base high impact polystyrene resin that can be used in the system. The base high impact polystyrene resin can have a Physical Specific Gravity D792_1.04, Mechanical Flexural Modulus D790 psi 277,000 Flexural Strength @yield D790 psi 6,200 Hardness-Rockwell D785 _R95, L60 Gardener Impact @73° F. D3029 in-lb 160 Izod Impact Strength Notched @73° F., Notched @0° F., D256 ft-lb/in, a Tensile Elongation @break D638% 52.0, a Tensile Modulus D638 psi 239,000a Tensile Strength @break @yield for D638at 3,500 to 2,800 psi. The HIPS can have certain thermal characteristics, including a coefficient of Thermal Expansion D696 in/in/° F. 5.0×10^−5, a Flammability Rating—UL94 @0.058"-HB, and a Heat Deflection Temperature @66 psi.

The system can include foam, such as a foam made from polyurethane, that fills a chamber formed by the inner surface apart from the rigid surface between the compressible first side and the compressible second side.

The compressible flexible strips can have a foam, which can be a medium density open celled foam, such as an urethane-ether foam. The foam can be adhered to the inner surface of the covering section through a fastening means, such as with an epoxy glue, a webbing saturated with a glue, webbing saturated with an adhesive, heat welding, or two sided adhesive tape.

In one or more embodiments, the compressible first and second sides can be adhered with a fastening means, such as a vehicle adhesive, a two sided adhesive tape or combinations thereof.

In one or more embodiments, the fastening means for the foam can be different from the fastening means for the compressible first and second sides.

The foam can be used for enveloping all of the irregular area or a user specified portion of the irregular area when the compression pressure is applied to the compressible first and second sides.

In one or more embodiments, the foam can be a closed cell foam or an open cell foam. As an example, the open cell foam could be the same open cell foam as the foam used on a paint roller, and can have a thickness ranging from about ½ of an inch to about 1 inch.

The film can be a film made by 3M, Inc. of St. Paul, Minn., such as 3M-ij80c-10 film.

The film can have a message area, which can be an 8 foot by 20 foot area of the film. The film can be smoothly connected with a first side of the rigid surface of the vehicle.

The film can smoothly connect over the smooth outer surface of the compressible flexible strips to engage a second side of the rigid surface of the vehicle, thereby forming the smooth message connected to two compressible flexible strips, which can be applied to the outside of the vehicle.

The smooth message can be within the message area of the film. The smooth message can include words, graphics, color, or combinations thereof.

The covering section can have compressible first and second sides, which can have thicknesses identical to the remainder of the covering section, such as compressible first and second sides with thicknesses ranging from about $1/64^{th}$ of an inch to about $1/16^{th}$ of an inch.

The irregular areas can be made up of structural differences, such as a surface with rivets or other components that extend from the vehicle, such as tabs or ribs that are part of an overall flat rigid surface.

One or more embodiments generally relate to a method for applying a smooth message on a vehicle. The method can include cleaning an irregular area of a rigid surface of the vehicle, such as washing the vehicle at a car wash.

The method can include applying an adhesive to each of the compressible first and second sides of each compressible flexible strip.

Pressure can be applied to the compressible flexible strips over rivets or other irregular areas.

A film with a message can be secured to a first side of the rigid side of the vehicle.

The film can then be unrolled onto the rigid surface and applied to the compressible flexible strips attached to the vehicle. The method can include smoothing the film from one side to the other, from top to bottom, or vice versa.

The film can be attached to both sides of the rigid surface and the compressible flexible strips, thereby forming the smooth message.

For example, in one or more embodiments an individual can have a need to apply a graphic film on an RV, a box truck, an enclosed trailer, a bus or a boat with an irregular surface, such as one including rivets or irregular screw heads.

In one or more embodiments, the compressible flexible strips can be applied over the rigid surface to conceal the irregular areas of the rigid surface, such as by placing the compressible flexible strips over the rivets or screws.

One or more embodiments can have compressible flexible strips with a flat surface, which can allow the film to be applied over the compressible flexible strips to flatten over the irregular areas.

The compressible flexible strips can create an almost seamless interface with the rigid surface that surrounds the irregular areas, thus allowing the individual to apply the film to the rigid surface without heat or special effort, which is contrary to the prior art which can generally require that the irregular areas be flattened and that heat be applied to the graphic film.

The compressible flexible strips can allow the individual to apply the graphic film over the irregular areas, keeping the film flat and free of bubbles or wrinkles.

Figure 1B:
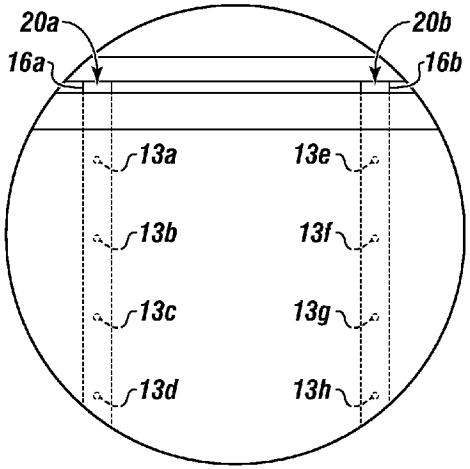
FIG. 1B is a magnification of a portion of the vehicle showing the compressible flexible strips according to one or more embodiments.

Turning now to the Figures, FIG. 1A depicts an embodiment of the system 9, including a vehicle 10, which can have a rigid surface 17. FIG. 1B is a magnification of a portion of the vehicle showing the compressible flexible strips according to one or more embodiments.

Referring to FIGS. 1A and 1B, the rigid surface 17 can have a first side 40 and a second side 42 opposite the first side 40.

The rigid surface 17 can have one or more irregular areas, such as irregular areas 13*a*, 13*b*, 13*c*, 13*d*, 13*e*, 13*f*, 13*g* and 13*h*.

A plurality of compressible flexible strips, such as compressible flexible strips 16*a* and 16*b*, can be attached in series and/or in parallel over the plurality of irregular areas 13*a*, 13*b*, 13*c*, 13*d*, 13*e*, 13*f*, 13*g* and 13*h*. Portions of the plurality of compressible flexible strips 16*a* and 16*b* can be configured to adhere flush to the rigid surface 17. Portions of the plurality of compressible flexible strips 16*a* and 16*b* can be configured to adhere over and around the irregular areas 13*a*, 13*b*, 13*c*, 13*d*, 13*e*, 13*f*, 13*g* and 13*h*.

A smooth message 15 can be formed on the rigid surface 17 of the vehicle 10. The smooth message 15 can be formed by a film 11 which can have a message area 12. For example, the film 11 can be smoothly connected with the rigid surface 17 and outer surfaces 20*a* and 20*b* of the plurality of compressible flexible strips 16*a* and 16*b*.

The message area 12 can be printed on the film 11, and can include words, graphics, color, or combinations thereof.

Figure 2:
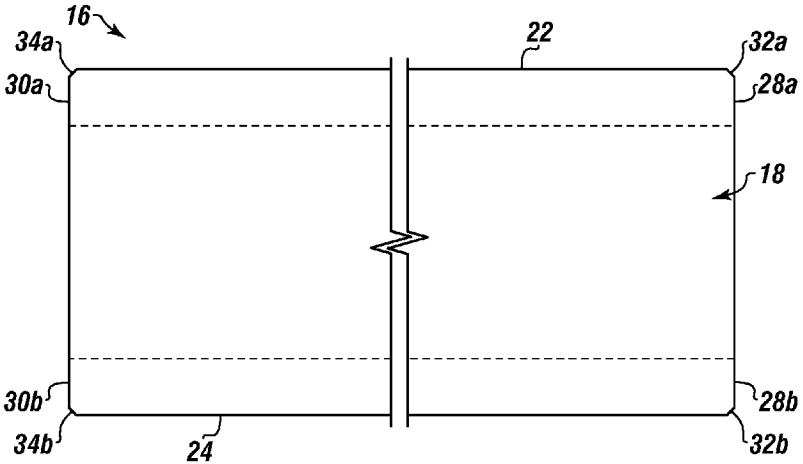
FIG. 2 is a top view of an embodiment of a compressible flexible strip according to one or more embodiments.

FIG. 2 depicts a top view of the compressible flexible strip 16.

The compressible flexible strip 16 can include a covering section 18. A compressible first side 22 can be connected longitudinally with the covering section 18.

A compressible second side 24 can be connected longitudinally with the covering section 18. The compressible second side 24 can be disposed parallel and opposite to the compressible first side 22.

The compressible first side 22 and compressible second side 24 can each have top edges 28*a* and 28*b* and bottom edges 30*a* and 30*b*. The top edges 28*a* and 28*b* can have top edge beveled portions 32*a* and 32*b*. The bottom edges 30*a* and 30*b* can have bottom edge beveled portions 34*a* and 34*b*.

Figure 3:
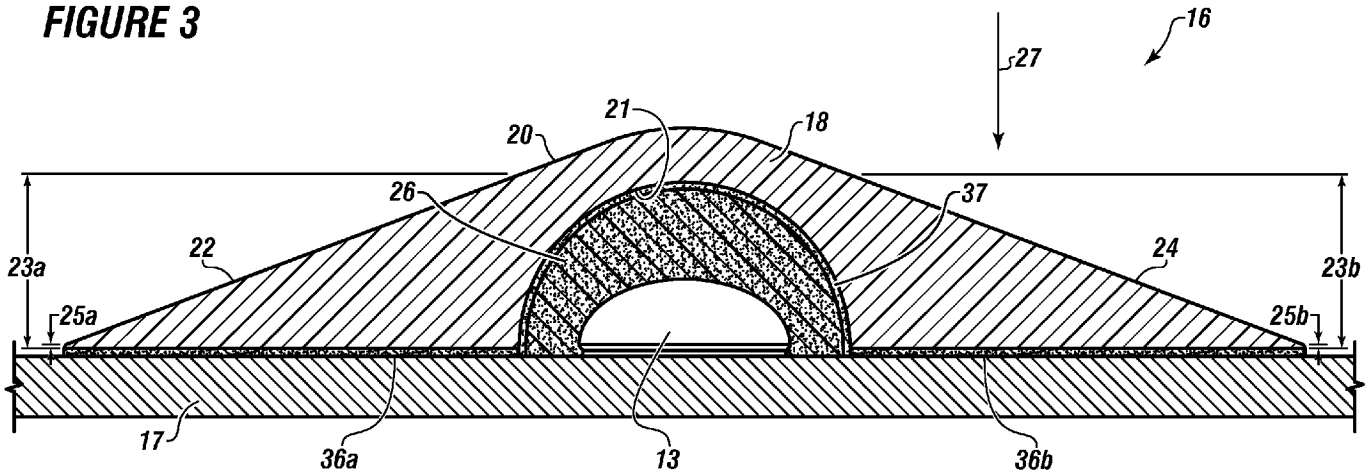
FIG. 3 is a cross section of a compressible flexible strip additionally showing an irregular area according to one or more embodiments.

FIG. 3 depicts a cross sectional view of the compressible flexible strip 16 engaged with the rigid surface 17.

The compressible flexible strip 16 can be made of 100 percent polyolefin polymer, high impact polystyrene, lightweight metal, aluminum composite, or combinations thereof. The compressible flexible strip 16 can be made of a material configured to resist breaking, resist shattering, and maintain an original shape at a temperature ranging from about −10 degrees Fahrenheit to about 120 degrees Fahrenheit.

In one or more embodiments, the compressible flexible strip 16 can include a plastic, non-perforated, compressible first side, plastic, non-perforated, compressible second side, and metal covering section.

The covering section 18 of the compressible flexible strip 16 can have a smooth outer surface 20 and an inner surface 21 for enclosing the irregular areas. In operation, the covering section 18 can be supported over the irregular areas without adhering to the rigid surface of the vehicle. The covering section 18 can have a thickness ranging from about $1/64^{th}$ of an inch to about $1/16^{th}$ of an inch, and can extend from about $1/8^{th}$ of an inch to about $1/4^{th}$ of an inch above the rigid surface 17.

The compressible flexible strip 16 can have a foam 26 that can be adhered to the inner surface 21 via a first adhesive 37, such as an adhesive tape. The foam 26 can be connected with the inner surface 21 via a fastening means, such as an adhesive, heat welding, two sided adhesive tape, webbing saturated with a glue, webbing saturated with an adhesive, or combinations thereof.

The foam 26 can be a closed cell foam, an opened cell foam, a high density cell foam, or a medium density cell foam.

In operation, the foam 26 can seal the compressible flexible strip 16 against an irregular area 13 on the rigid surface 17. The foam 26 can be configured to envelop a user specified portion of the irregular area 13 when the compression pressure is applied to the compressible first side 22 and compressible second side 24.

The irregular area 13 can be rivets, screws, tabs, framing, joints, ribs, or combinations thereof.

The compressible flexible strip 16 can have a compressible first side 22 and a compressible second side 24 disposed adjacent the covering section 18.

The compressible first side 22 and compressible second side 24 can each have a first thickness 23*a* and 23*b* that can be identical to the thickness of the covering section 18.

The compressible first side 22 and compressible second side 24 can each taper to a second thickness 25*a* and 25*b* that can be less than 10 percent of the first thickness 23*a* and 23*b*.

A second adhesive 36*a* and 36*b* can attach the compressible first side 22 and compressible second side 24 to the rigid surface 17.

The compressible first side 22 and compressible second side 24 can be adhered with the rigid surface 17 via a vehicle adhesive, a two sided adhesive tape, or combinations thereof.

The second adhesive 36*a* and 36*b* can be 100 percent removable from the compressible first side 22, compressible second side 24, and the rigid surface 17; thereby providing a clean surface on the rigid surface 17 when the smooth message is removed therefrom.

In one or more embodiments, the first adhesive 37 can be different than the second adhesive 36*a* and 36*b*.

In operation, the compressible first side 22 and compressible second side 24 can be configured to simultaneously adhere flush to the rigid surface 17 upon simultaneous application of a compression pressure along a compression pressure direction 27. The compression pressure can range from about 15 psi to about 20 psi.

Figure 4:
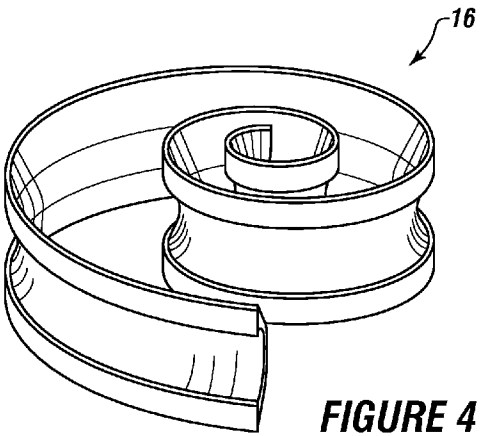
FIG. 4 is a side view of a roll version of the compressible flexible strip according to one or more embodiments.

FIG. 4 is a side view of a roll version of the compressible flexible strip 16.

While these embodiments have been described with emphasis on the embodiments, it should be understood that within the scope of the appended claims, the embodiments might be practiced other than as specifically described herein.

What is claimed is:

1. A system for accelerated installation of smooth messages over irregular areas on vehicles, the system comprising:

a. a vehicle having a rigid surface, wherein the rigid surface has an irregular area;

b. a plurality of compressible flexible strips for attaching in series or parallel over the irregular area, wherein portions of the plurality of compressible flexible strips are configured to adhere flush to the rigid surface around the irregular area, and wherein each compressible flexible strip comprises:

(i) a covering section having a smooth outer surface and an inner surface for enclosing the irregular area, wherein the covering section is supported over the irregular area without adhering to the rigid surface, and wherein the covering section has a thickness ranging from $1/64^{th}$ of an inch to $1/16^{th}$ of an inch;

(ii) a compressible first side connected longitudinally with the covering section;

(iii) a compressible second side connected longitudinally with the covering section, wherein the compressible second side is disposed parallel and opposite to the compressible first side, wherein the compressible first side and the compressible second side each have a first thickness identical to the thickness of the covering section, and further wherein the compressible first side and the compressible second side each taper to a second thickness that is less than 10 percent of the first thickness, and wherein the compressible first side and the compressible second side are configured to simultaneously adhere flush to the rigid surface when a compression pressure is applied to the compressible first side and the compressible second side; and (iv) a foam adhered to the inner surface of the covering section, wherein the foam envelops the irregular area when the compression pressure is applied to the compressible first side and the compressible second side, thereby adhering the compressible flexible strip to the rigid surface; and c. a film comprising a message area, wherein the film is configured to smoothly adhere to a first side of the rigid surface and to smoothly adhere to the smooth outer surfaces of the plurality of compressible flexible strips to smoothly adhere to a second side of the rigid surface, thereby forming a smooth message.

2. The system of claim 1, wherein each covering section extends from $1/8^{th}$ of an inch to $1/4^{th}$ of an inch above the rigid surface.

3. The system of claim 1, wherein each compressible flexible strip comprises 100 percent polyolefin polymer or high impact polystyrene.

4. The system of claim 1, wherein each compressible flexible strip comprises a lightweight metal, an aluminum composite, or combinations thereof.

5. The system of claim 1, wherein each compressible flexible strip comprises:

a. a plastic, non-perforated, compressible first side and a plastic, non-perforated, compressible second side; and b. a metal covering section.

6. The system of claim 1, wherein the plurality of compressible flexible strips resist breaking, resist shattering, and maintain an original shape at a temperature ranging from −10 degrees Fahrenheit to 120 degrees Fahrenheit.

7. The system of claim 1, wherein the compressible first side and the compressible second side each have top edges and bottom edges, wherein the top edges have top edge beveled portions, and wherein the bottom edges have bottom beveled portions.

8. The system of claim 1, wherein the irregular area comprises: rivets, screws, tabs, framing, joints, ribs, or combinations thereof.

9. The system of claim 1, wherein the foam is a closed cell foam or an opened cell foam.

10. The system of claim 9, wherein the foam is a high density cell foam or a medium density cell foam.

11. The system of claim 1, wherein the message area is printed on the film.

12. The system of claim 1, wherein the message area comprises words, graphics, color, or combinations thereof.

13. The system of claim 1, wherein compression pressure ranges from 15 psi to 20 psi.

14. The system of claim 1, wherein the foam is adhered to the inner surface of the covering section via: an adhesive, heat welding, two sided adhesive tape, webbing saturated with a glue, webbing saturated with an adhesive, or combinations thereof.

15. The system of claim 1, wherein the compressible first side and the compressible second side are adhered with the rigid surface via: a vehicle adhesive, a two sided adhesive tape, or combinations thereof.

16. The system of claim 15, wherein the vehicle adhesive, the two sided adhesive tape, or combinations thereof are 100 percent removable from the compressible first side, the compressible second side, and the rigid surface, thereby providing a clean surface on the rigid surface when the smooth message is removed therefrom.

17. The system of claim 1, wherein the foam is adhered to the inner surface of the covering section via a first adhesive, wherein the compressible first side and the compressible second side are adhered with the rigid surface via a second adhesive, and wherein the first adhesive is different than the second adhesive.

18. A system for accelerated installation of messages over irregular areas on vehicles, the system comprising:

a. a vehicle having a rigid surface, wherein the rigid surface has an irregular area;

b. a plurality of compressible flexible strips for attaching in series or parallel over the irregular area, wherein portions of the plurality of compressible flexible strips are configured to adhere flush to the rigid surface around the irregular area, and wherein each compressible flexible strip comprises:

(i) a covering section having an outer surface and an inner surface for enclosing the irregular area, wherein the covering section is supported over the irregular area without adhering to the rigid surface;

(ii) a compressible first side connected longitudinally with the covering section;

(iii) a compressible second side connected longitudinally with the covering section, wherein the compressible second side is disposed parallel and opposite to the compressible first side, and wherein the compressible first side and the compressible second side are configured to simultaneously adhere flush to the rigid surface upon simultaneous application of a compression pressure; and (iv) a foam adhered to the inner surface, wherein the foam is configured to envelop a portion of the irregular area when the compression pressure is applied to the compressible first side and the compressible second side; and c. a film comprising a message area, wherein the film is configured to connect with a first side of the rigid surface, the outer surfaces of the plurality of compressible flexible strips, and a second side of the rigid surface, thereby forming a message.

19. A system for accelerated installation of messages over irregular areas on vehicles, the system comprising:

a. a plurality of compressible flexible strips configured for attaching in series or parallel over an irregular area of a rigid surface of a vehicle, wherein portions of the plurality of compressible flexible strips are configured to adhere flush to the rigid surface around the irregular area, and wherein each compressible flexible strip comprises:

(i) a covering section having an outer surface and an inner surface for enclosing the irregular area, wherein the covering section is supported over the irregular area without adhering to the rigid surface;

(ii) a compressible first side connected longitudinally with the covering section;

(iii) a compressible second side connected longitudinally with the covering section, wherein the compressible second side is disposed parallel and opposite to the compressible first side, and wherein the compressible first side and the compressible second side are configured to simultaneously adhere flush to the rigid surface upon simultaneous application of a compression pressure; and (iv) a foam adhered to the inner surface, wherein the foam is configured to envelop a portion of the irregular area when the compression pressure is applied to the compressible first side and the compressible second side; and (v) a film comprising a message area, wherein the film is configured to connect with a first side of the rigid surface, the outer surfaces of the plurality of compressible flexible strips, and a second side of the rigid surface, thereby forming a message.

* * * * *